US011821298B1

(12) United States Patent
Fisher

(10) Patent No.: US 11,821,298 B1
(45) Date of Patent: Nov. 21, 2023

(54) ONSITE PROCESSING OF OVERSIZED PROPPANT DEBRIS TO PUMPABLE MATERIAL SIZE

(71) Applicant: Halliburton Energy Services, Inc., Houston, TX (US)

(72) Inventor: Chad A. Fisher, Cache, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/809,309

(22) Filed: Jun. 28, 2022

(51) Int. Cl.

| | |
|---|---|
| ***E21B 43/267*** | (2006.01) |
| ***B02C 23/08*** | (2006.01) |
| ***B07B 1/04*** | (2006.01) |
| ***E21B 43/26*** | (2006.01) |

(52) U.S. Cl.
CPC ..... *E21B 43/267* (2013.01); *B02C 23/08* (2013.01); *B07B 1/04* (2013.01); *E21B 43/2607* (2020.05)

(58) Field of Classification Search
USPC ..... 166/75.15
See application file for complete search history.

(56) References Cited

U.S. PATENT DOCUMENTS

| | | | | |
|---|---|---|---|---|
| 3,469,961 | A * | 9/1969 | Barnhart | C21B 3/08 65/141 |
| 5,570,749 | A * | 11/1996 | Reed | E21B 21/066 175/207 |
| 5,814,230 | A * | 9/1998 | Willis | B01D 33/333 210/384 |
| 7,520,342 | B2 * | 4/2009 | Butler | E21B 21/066 175/66 |
| 8,424,784 | B1 * | 4/2013 | Munisteri | C09K 8/80 241/3 |
| 9,896,918 | B2 * | 2/2018 | Munisteri | E21B 43/267 |
| 2014/0000891 | A1 * | 1/2014 | Mahoney | C09K 8/805 507/224 |
| 2014/0027386 | A1 * | 1/2014 | Munisteri | B01D 21/34 210/243 |
| 2020/0240238 | A1 | 7/2020 | Oehler et al. | |
| 2020/0240239 | A1 | 7/2020 | Oehler et al. | |
| 2022/0363982 | A1 * | 11/2022 | Fisher | F26B 9/00 |

* cited by examiner

*Primary Examiner* — Matthew R Buck
*Assistant Examiner* — Douglas S Wood
(74) *Attorney, Agent, or Firm* — K&L Gates LLP

(57) ABSTRACT

The present disclosure relates to a system for processing a mixed proppant at a wellsite for a well, the system including a separator including a screen configured to receive the mixed proppant that includes a proppant meeting a desired size criteria and an oversized proppant exceeding the desired size criteria, sort the proppant from the oversized proppant, direct the proppant along a primary flow path to a blender, and direct the oversized proppant along a diverted flow path to a reducer. The reducer is operable to process the oversized proppant into a processed proppant that meets the desired size criteria.

20 Claims, 5 Drawing Sheets

ONSITE PROCESSING OF OVERSIZED PROPPANT DEBRIS TO PUMPABLE MATERIAL SIZE

BACKGROUND

This section is intended to provide relevant contextual information to facilitate a better understanding of the various aspects of the described embodiments. Accordingly, it should be understood that these statements are to be read in this light and not as admissions of prior art.

In the course of completion or remediation of oil and gas wells, fracturing operations are often performed on the well by pumping a fracturing slurry under high pressures that create fractures in the oil or gas-bearing formations. Solid proppant (e.g., sand, rocks, crushed rocks, etc.) is used in the fracturing slurry to prevent closure of the created fractures once the fracturing pressures are removed. The use of proppants and other solids in performing such fracturing operations can be hard on the equipment used to transfer the slurry into the well (e.g., mixing, transport, and pumping equipment). For example, in conventional systems, banks of pumps are used to pressurize a proppant slurry for transport down into the wellbore, and the pumps can experience substantial wear as a result of the proppant and other solids in the slurry moving through the pumps. Additionally, the proppant and other solids may clog the pumps and/or the wellbore if the composition of the proppant and other solids is not controlled.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
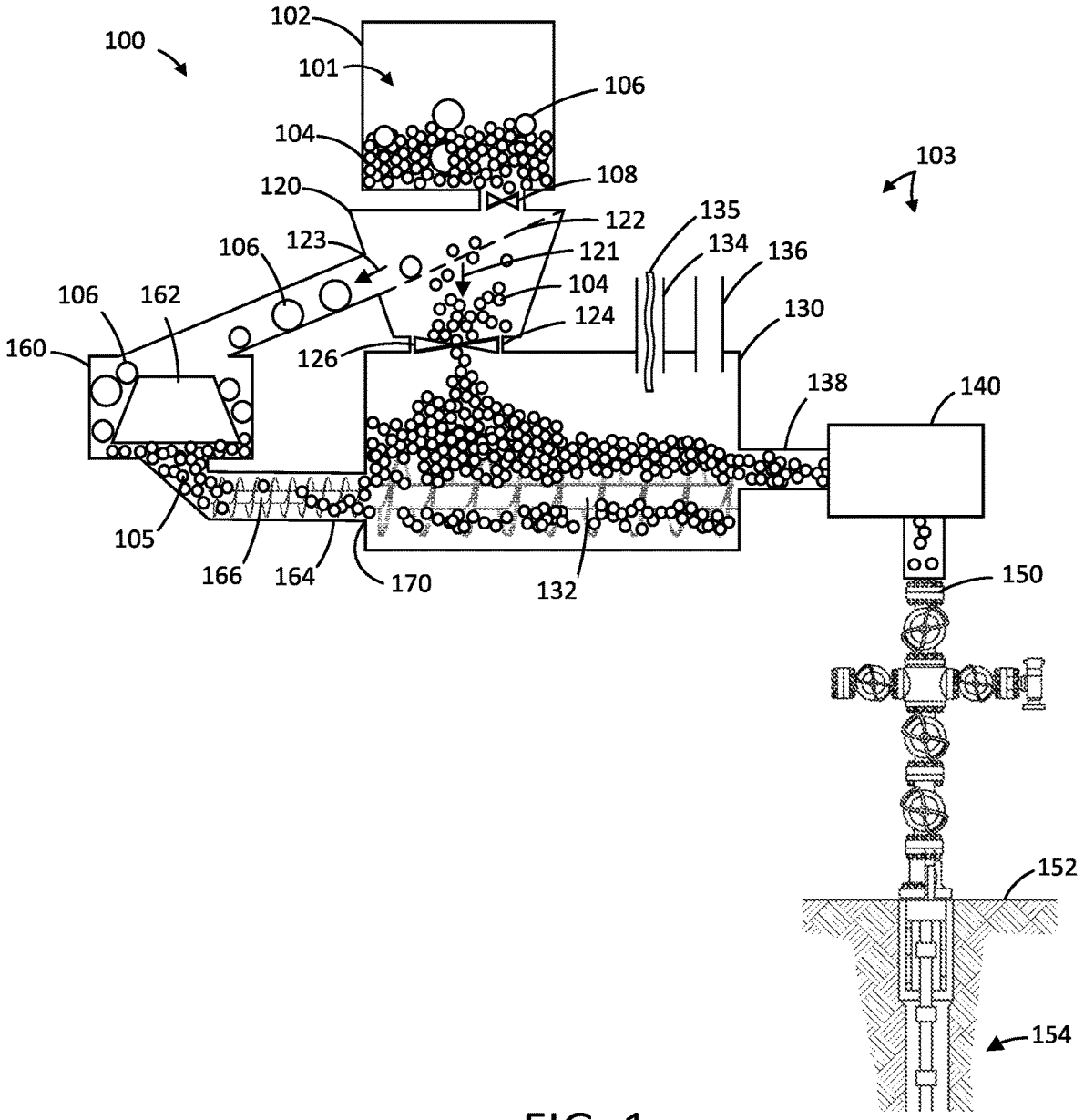
FIG. 1 is a schematic view of a system for processing a mixed proppant within a slurry provided to a wellhead in accordance with the present disclosure.

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

During fracturing operations, the amount of proppant added to the fracturing slurry should be controlled to ensure optimal performance of the proppant once pumped into the formation. Once introduced into the well, the proppant serves to hold open fluid paths through fractures in the formation and to provide increased flow rates of hydrocarbons through the fractures. Because formations also have natural permeability with regards to the rate of hydrocarbon flow therethrough, the amount of proppant within the slurry and thus the degree of proppant added to the formation will be adjusted to reach the most economical hydrocarbon production (e.g., "target well design"). Adding more proppant to the formation that needed for the target well design is not cost effective because the increased cost of the proppant and the fracturing operations are not offset by the value of the additional hydrocarbons gained from the formation. Similarly, adding less proppant than is needed for the target well design also results in inefficient hydrocarbon production because the value of the additional hydrocarbons gained from the formation is greater than the cost of the additional proppant and fracturing operations. For the target well design, the proppant added to the fracturing slurry should be of a particular desired size (e.g., the size of the particles within the proppant, or size range) to be effective in the wellbore and to allow for proper operation of the surface equipment used for fracturing the well. With respect to the well, proppant that is too large may clog the perforations between the wellbore and the formation, may not enter the fractures in the formation, and may clog or otherwise impede the oil and gas flow in the wellbore.

Proppant that is too small may not hold open the fractures and may not provide a desirable flow path for the oil and gas. Additionally, with respect to the surface equipment, proppant that is too large may clog or damage the fracturing pumps. Accordingly, proppant is graded according to American Petroleum Institute standards ("API standards") to ensure various mechanical properties, including the particle size. However, new sources and suppliers of proppant have shown inconsistency in quality control and thus may deliver proppant to the wellsite which has some particles that are larger than what is allowed by the API standards. Rejecting an entire proppant shipment results in costly delays when fracturing the well. Similarly, accepting the proppant shipments with particles larger than the API standards is also costly for a variety of reasons. For example, with current methods, it is costly and time consuming to inspect each proppant shipment and to then separate out the particles that are larger than the API standard. Additionally, any proppant that is sorted out and rejected for failing the API standards must then be removed from the wellsite and disposed of at considerable expense. Accordingly, there is a need to control the amount of proppant within a slurry while efficiently sorting large particles from proppant sources, not creating timing delays for the use of the acceptable proppant, and while not amassing volumes of rejected proppant that needs to be removed from the wellsite.

Referring to FIG. 1, a system 100 is shown at a wellsite 152. As described herein, the system 100 is part of a larger fracking system 103 coupled to a wellhead 150 of a well 154 at the wellsite 152. The system 100 comprises a hopper 102 containing a mixed proppant 101. As described herein, the hopper 102 shall be understood broadly to include any bin or equipment for storing a volume of the mixed proppant 101. In the example of FIG. 1, the hopper 102 is a container that may be refilled with additional mixed proppant 101. Alternatively, the hopper 102 may be replaced with another piece of equipment such as a conveyor, auger, or other type of container. The hopper 102 may also be a replaceable container such that a new hopper 102 may be added when the hopper 102 is removed. The mixed proppant 101 includes a proppant 104 that has the desired size criteria and an oversized proppant 106 that is larger than the desired size criteria. (For example, the "desired size criteria" may correspond to an API standard, where the particle size is graded according to screen mesh ranges. In particular, particles passing through a first screen mesh are determined to be smaller than the mesh holes in the first screen, while particles stopped by a second screen mesh are determined to be larger than the mesh holes of the second screen. Thus a 40/70 mixed proppant would pass through a 40 mesh screen, but would not pass through a 70 mesh screen. A few common sizes specified by the API standard include but are not limited to: 12/20, 20/40, 30/50, and 40/70.) The system 100 further comprises a hopper valve 108 that is operable to control the flow of the mixed proppant 101 from the hopper 102 to a separator 120. In some designs, the separator 120 may be stationary and use only the force of gravity. Alternatively the separator 120 may also have a power input and move during operation such as a vibratory shaker. In the example of FIG. 1, the hopper 102 is positioned above the separator 120 such that gravity can flow the mixed proppant 101 through the hopper valve 108. However, the hopper 102 may alternatively be placed at the same height or below the separator 120. Optionally, the hopper valve 108 may also be replaced with a conveyor belt or auger (not shown) that could be used to transfer the mixed proppant 101 into the separator 120. The separator 120 includes a screen 122 that has a plurality of passages therethrough of a certain size that allow the proppant 104 to pass while not allowing the oversized proppant 106 to pass. In this manner, the mixed proppant 101 is sorted as the proppant 104 is separated from the oversized proppant 106. During operation, the separator 120 may move, shift, or vibrate to urge the separation of the mixed proppant 101. The flow of the proppant 104 is shown along a primary flow path 121 that extends downward through a first solids blender-inlet 124 in a blender 130, while the flow of the oversized proppant 106 is shown as moving along a diverted flow path 123. In the example of FIG. 1, the first solids blender-inlet 124 includes a metering gate 126 used to control the flow of the proppant 104 downstream of the screen 122. In the example of FIG. 1, the screen 122 is shown angled downward on one edge so that the diverted flow path 123 extends downward toward the lower edge of the screen 122. However, the screen 122 could alternatively not be angled or may be angled upward on one edge such that the diverted flow path 123 extends upwards along the screen 122.

As the proppant 104 moves along the primary flow path 121, the proppant 104 enters the blender 130 and a blender-auger 132 is used to mix the proppant 104 into a slurry with liquids 135 (e.g., water) added from a liquids inlet 134. Other liquid or solid additives may also be added from an additives inlet 136. Once mixed into a slurry, the blender-auger 132 moves and transfers the slurry, including the proppant 104, through an outlet 138 in the blender 130. The slurry then flows into a pump 140 that pressurizes the slurry and flows the pressurized slurry into a wellhead 150 and into an oil or gas-bearing formation below.

The oversized proppant 106 moves along the diverted flow path 123 to a reducer 160. The example of FIG. 1 shows the reducer 160 below the separator 120, and thus the diverted flow path 123 extends along a chute or pipe that transfers the oversized proppant 106 with gravity. However, the reducer may alternatively be at the same level as the separator 120, or may be positioned higher than the separator 120. For example, the diverted flow path 123 may extend upward along the screen 122 of the separator 120, as thus the screen 122 may be configured to lift and direct the oversized proppant 106 into the reducer 160. Additionally, other methods of transferring the oversized proppant 106 are contemplated such as using a conveyor belt or an auger.

Once the oversized proppant 106 is transferred along the diverted flow path 123, the oversized proppant enters the reducer 160, and a reducer feed 162 operates to refine (e.g., reduce, break, crush, etc.) the particle size of the oversized proppant 106. In the example of FIG. 1, the reducer 160 is a cone crusher, however other methods of particle size refinement are contemplated (e.g., jaw crusher, auger crusher, ball mill, rod mill, hammer mill, impactor, pulverizer, breaker plate mill). In the example of a cone crusher for the reducer 160, the reducer feed 162 is generally conical and rotates to advance the oversized proppant 106 from the top of the reducer 160 to the bottom of the reducer 160. The conical reducer feed 162 forms a progressively smaller gap with the housing of the reducer 160, thus the oversized proppant 106 is refined (e.g., broken into smaller particles) as the oversized proppant 106 passes from the top to the bottom of the reducer 160. The oversized proppant 106 exits the reducer as a processed proppant 105 that meets the same size criteria as the proppant 104. The processed proppant 105 is then directed along a reducer-blender transfer outlet 164 from the reducer 160 using a transfer-auger 166, and rejoins the primary flow path 121 of the proppant 104 in the blender 130 at a position downstream of the separator 120.

The transfer-auger 166 is coupled to and is operable with the blender-auger 132, such that rotation of the augers 132, 166 is the same. However, it is also contemplated that the augers 132, 166 are not coupled and are independently operable.

In the example of FIG. 1, the processed proppant 105 enters the blender 130 along an optional second solids blender-inlet 170 that is spaced apart from the first solids blender-inlet 124. However, it is also contemplated that the second solids blender-inlet 170 may not be spaced apart from the first solids blender-inlet 124, or the second solids blender-inlet 170 and potentially even the transfer-auger 166 may be omitted. Thus the processed proppant 105 may alternatively be added through the first solids blender-inlet 124. When omitting the transfer-auger 166, it is contemplated that the reducer-blender transfer outlet 164 may be configured to convey the processed proppant 105 to the blender 130 with gravity (e.g., via a gravity chute, not shown). Also the processed proppant 105 may optionally be added to the proppant 104 before the processed proppant 105 and the proppant 104 are added to the blender 130.

A controller (e.g., controller 600) is used to operate the components of the system 100 to adjust the amount of the mixed proppant 101 added to the system 100 and to control the amounts of the proppant 104 and/or the processed proppant 105 added to the blender 130. As detailed below, volumetric flowrates of the proppants may be used to coordinate the control of the hopper valve 108, the metering gate 126, and/or the transfer-auger 166 to ensure the desired total proppant volume is added to the blender 130. The volumetric flow rate may be a directly measured with sensors (such as flowmeters, densitometers, pressure sensors, etc. (not shown)) or may be calculated flowrates. For example, a flowrate of proppant through a known orifice size may be calculated based on a measured time of orifice opening and the degree of opening. Similarly, a flow rate of an auger or conveyor belt can be calculated based on a measured duration of operation and operational speed.

In an example, the volumetric flow of the mixed proppant 101 into the blender 130 may be controlled by only the hopper valve 108, while the metering gate 126 may be omitted, and while the transfer-auger 166 is configured for continuous operation such that substantially all of the processed proppant 105 is added to the blender 130.

In another example, the volumetric flow of the mixed proppant 101 may not be measured by the operation of the hopper valve 108, but rather the operation of the metering gate 126 and the transfer-auger 166 may be coordinated to control the total flowrate of proppants 104, 105 into the blender 130. In particular, the metering gate 126 includes an adjustable orifice or passage (not shown) that can be selectively opened to an adjustable degree for an adjustable duration of time, the combination of which corresponds to a flowrate of proppant 104 into the blender 130 via the first solids blender-inlet 124. In addition, the operational speed of the transfer-auger 166 may be adjusted to further control the flowrate of the processed proppant 105 into the blender 130 in addition to control by the metering gate 126.

The processed proppant 105 and/or the proppant 104 satisfy the desired size criteria and the resulting slurry mixture is more compatible with the pump 140 (e.g., produces less clogging and/or damage to the pump 140). Additionally, the slurry pumped into the oil or gas-bearing formation has an effective sized proppant 104, 105 that both holds open the fractures in the formation, while also not blocking the wellbore fluid flow paths. Additionally, the separation of the oversized proppant 106 occurs concurrently with the addition of the proppant 104 into the blender 130, and thus there is no time delay in using the mixed proppant 101 to fracture the well 154. Further, the particle size refinement of the oversized proppant 106 into the processed proppant 105 may be performed as a continuous process as the well 154 is fractured, thus allowing immediate use of the processed proppant 105 in the slurry. In this manner, the rejected oversized proppant 106 does not accumulate at the wellsite 152, but instead provides usable processed proppant 105 that may be used to fracture the well 154 below the wellhead 150 or other wells (not shown).

Figure 2:
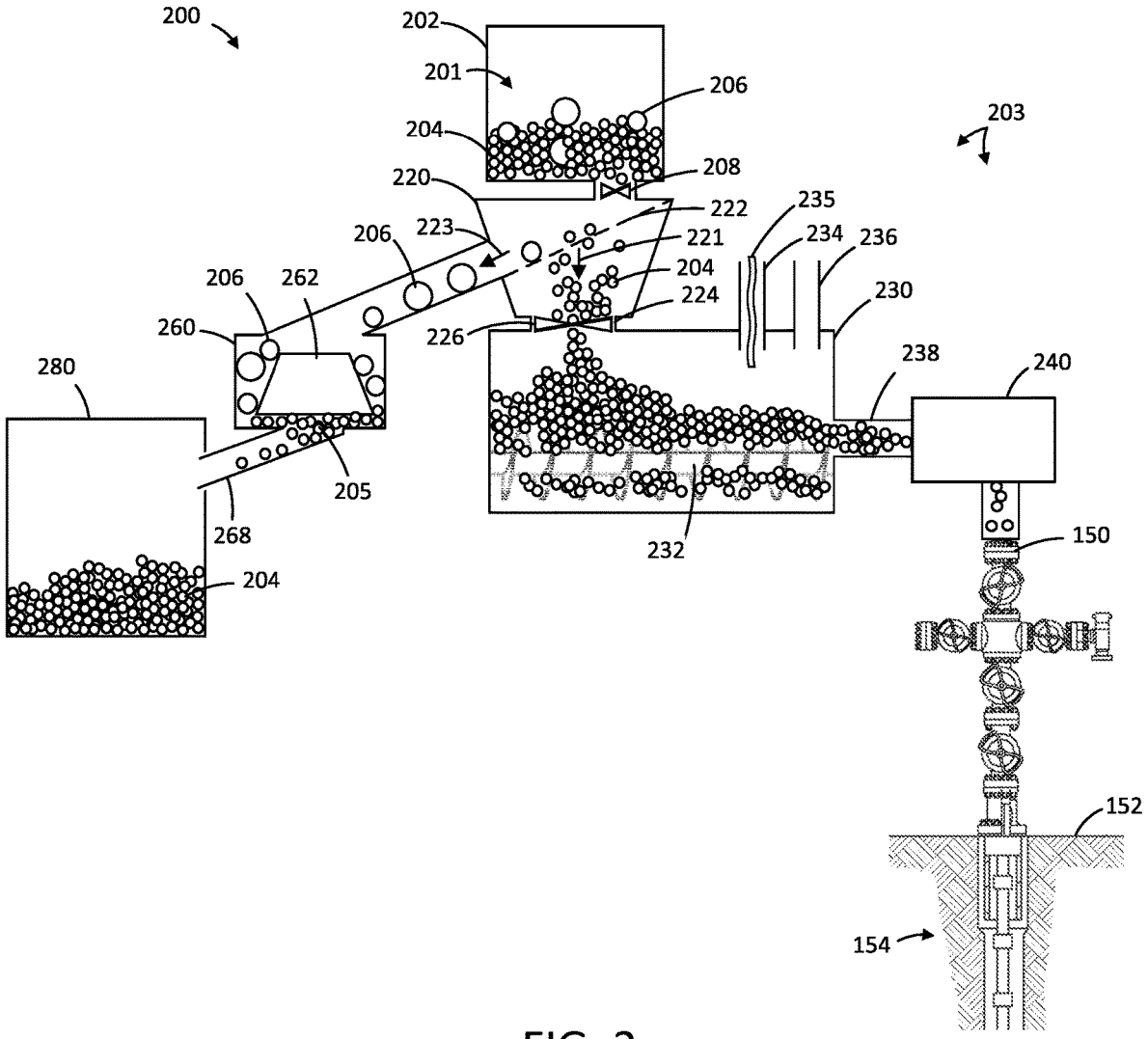
FIG. 2 is a schematic view of another embodiment of a system for processing a mixed proppant within a slurry provided to a wellhead in accordance with the present disclosure.

Referring to FIG. 2, another embodiment of a system 200 is shown at the wellsite 152. As described herein, the system 200 is part of a larger fracking system 203 coupled to the wellhead 150 of the well 154 at the wellsite 152. Generally speaking, some of the components of the system 200 are similar to the components of the system 100, and thus the same or similar reference numerals are used. In addition, the operational description is not repeated in the interest of brevity, but instead will focus on features of the system 200 that are different from the system 100. In particular, the system 200 comprises a storage bin 280 that is used to store a processed proppant 205. Thus, as described below, the system 200 processes an oversized proppant 206 from a mixed proppant 201, but then stores the processed proppant 205 rather than adding it to a blender 230.

Referring still to FIG. 2, the system 200 comprises a hopper 202 containing the mixed proppant 201. The mixed proppant 201 includes a proppant 204 that has the desired size criteria and an oversized proppant 206 that is larger than the desired size criteria. The system 200 further comprises a hopper valve 208 that is operable to control the flow of the mixed proppant 201 from the hopper 202 to a separator 220. In the example of FIG. 2, the hopper 202 is positioned above the separator 220 such that gravity can flow the mixed proppant 201 through the hopper valve 208. However, the hopper 202 may alternatively be placed at the same height or below the separator 220 and the hopper valve 208 may be replaced with a conveyor belt or auger (not shown), as described for the system 100. The separator 220 includes a screen 222 that has a plurality of passages therethrough that allow the proppant 204 to pass while not passing the oversized proppant 206. In this manner, the mixed proppant 201 is sorted as the proppant 204 is separated from the oversized proppant 206. During operation, the separator 220 may move, shift, or vibrate to urge the separation of the mixed proppant 201. The flow of the proppant 204 is shown along a primary flow path 221 that extends downward through a first solids blender-inlet 224 in the blender 230, while the flow of the oversized proppant 206 is shown extending along a diverted flow path 223. In addition, the first solids blender-inlet 224 includes a metering gate 226 used to control the flow of the proppant 204 downstream of the screen 222. The screen 222 is shown angled downward on one edge so that the diverted flow path 223 extends downward toward the lower edge of the screen 222. However, the screen 222 could alternatively not be angled or may be angled upward on one edge such that the diverted flow path 223 extends upwards along the screen 222.

As the proppant 204 moves along the primary flow path 221, the proppant 204 enters the blender 230, and a blender-auger 232 is used to mix the proppant 204 into a slurry with liquids 235 (e.g., water) added from a liquids inlet 234. Other liquid or solid additives may also be added to the slurry mixture from an additives inlet 236. Once mixed into a slurry, the blender-auger 232 moves and transfers the slurry, including the proppant 204, through an outlet 238 in the blender 230. The slurry then flows into a pump 240 that pressurizes the slurry and then flows the pressurized slurry into a wellhead 150 and into an oil or gas-bearing formation below.

Concurrently with transferring the proppant 204 along the primary flow path 221, the oversized proppant 206 is transferred along the diverted flow path 223 to a reducer 260. As described for the system 100, the reducer 260 may be positioned below the separator 220, as shown in the example of FIG. 2, may be positioned at the same level as the separator 220, or may be positioned higher than the separator 220.

Once the oversized proppant 206 of the diverted flow path 223 enters the reducer 260, a reducer feed 262 operates to refine (e.g., reduce, break, crush, etc.) the particle size of the oversized proppant 206. As described for the system 100, the example of the system 200 in FIG. 2 uses a cone crusher as the reducer 260, but other methods of particle size refinement are also contemplated. As the generally conical reducer feed 262 rotates, the oversized proppant 206 is advanced from the top of the reducer 260 to the bottom of the reducer 260. The progressively smaller gap between the reducer feed 262 and the housing of the reducer 260, refines (e.g., breaks into smaller particles) the oversized proppant 206 into a processed proppant 205. The processed proppant 205 has substantially the same particle size as the proppant 204, and thus also satisfies the desired size criteria. The processed proppant 205 is then directed along a transfer outlet 268 and is stored in the storage bin 280 for later use with the wellhead 150 or another similar wellhead (not shown). When the storage bin 280 becomes full of the processed proppant 205, the storage bin 280 may be removed and replaced with another storage bin (not shown, but substantially the same as the storage bin 280), and the new storage bin may be used to store additional processed proppant 205. It should be appreciated that because the processed proppant 205 satisfies the desired size criteria, the processed proppant 205 in the storage bin 280 may be added to the blender 230 directly (e.g., downstream of the separator 220 and the screen 222). Alternatively, the processed proppant 205 may be added to the separator 220 between the screen 222 and the blender 230 (e.g., downstream of the screen 222 and upstream of the blender 230). Alternatively, the processed proppant 205 in the storage bin 280 may be added to the hopper 202 and thus may again pass through the separator 220 and the screen 222 in the same manner previously described for the mixed proppant 201.

A controller (e.g., controller 600) is used to operate the components of the system 200 to adjust the amount of the mixed proppant 201 added to the system 200 and to control the amounts of the proppant 204 added to the blender 230.

In an example, the volumetric flow of the mixed proppant 201 into the sorter 220 is controlled by the selective operation of the hopper valve 208, while the volumetric flow of the proppant 204 is controlled by the selective operation of the metering gate 224. In particular, the metering gate 226 includes an adjustable orifice or passage (not shown) that can be selectively opened to an adjustable degree for an adjustable duration of time, the combination of which corresponds to a flowrate of the proppant 204 into the blender 230 via the first solids blender-inlet 224. If the desired amount of the proppant 204 is not available for flow through the metering gate 224, the hopper valve 208 can again selectively open or be opened to an increased degree.

The proppant 204 satisfies the desired size criteria, and the resulting slurry mixture is more compatible with the pump 240 (e.g., produces less clogging and/or damage to the pump 240). Additionally, the slurry pumped into the oil or gas-bearing formation has an effective sized proppant 204 that both holds open the fractures in the formation, while also not blocking the wellbore fluid flow paths. Additionally, the separation of the oversized proppant 206 and transfer along the diverted flow path 223 occurs concurrently with the addition of the proppant 204 into the blender 230, and thus there is no time delay in using the mixed proppant 201 to fracture the well 154. Further, the particle size refinement of the oversized proppant 206 into the processed proppant 205 is a continuous process, which occurs concurrently with the fracturing of the well 154. Thus the rejected oversized proppant 206 does not accumulate at the wellsite 152, but instead provides usable processed proppant 205 that may be used to fracture the well 154 below the wellhead 150 or other wells (not shown).

Figure 3:
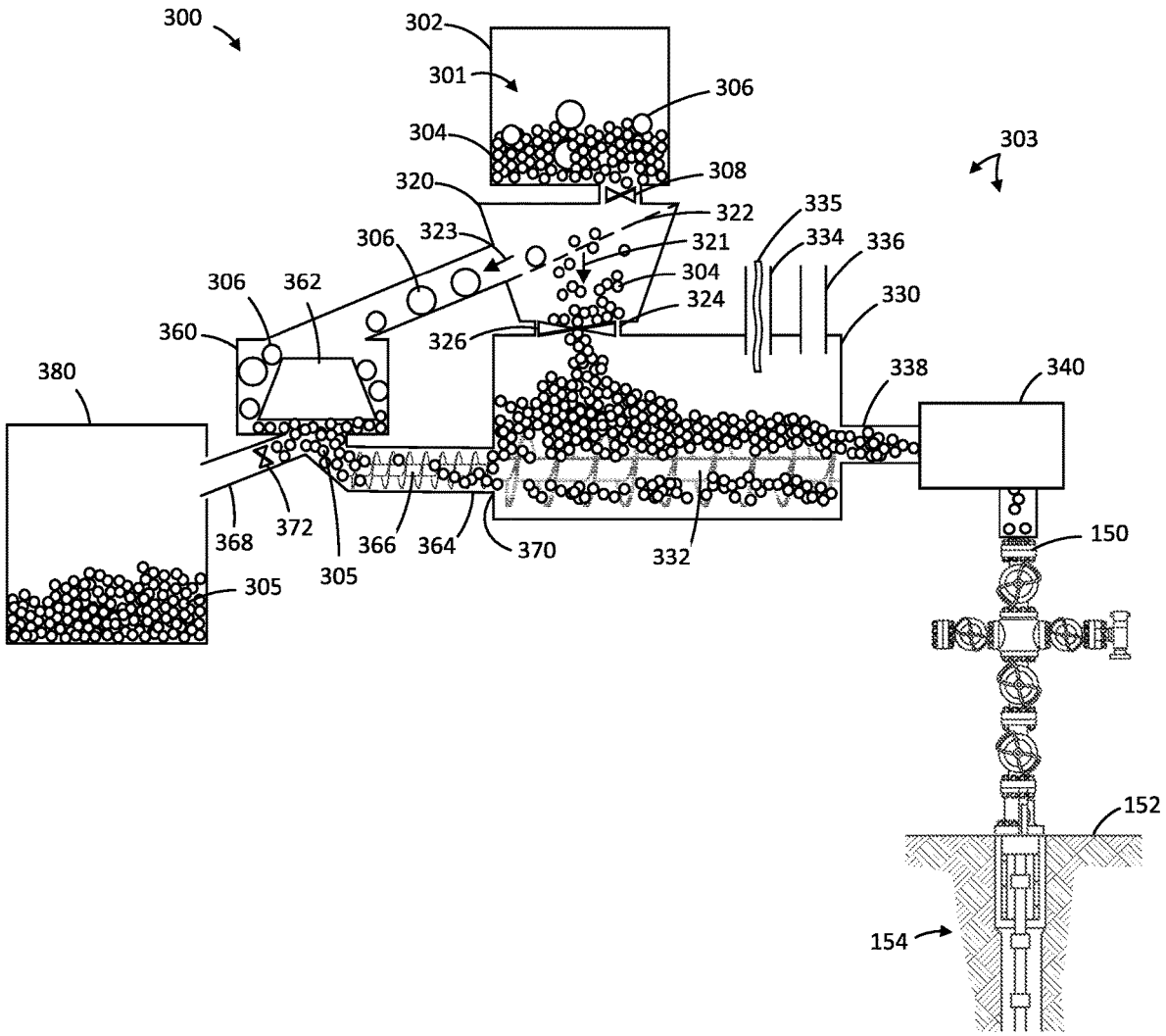
FIG. 3 is a schematic view of another embodiment of a system for processing a mixed proppant within a slurry provided to a wellhead in accordance with the present disclosure.

Referring to FIG. 3, a system 300 is shown that is used in place of the systems 100, 200. As described herein, the system 300 is part of a larger fracking system 303 coupled to the wellhead 150 of the well 154 at the wellsite 152. As discussed previously for systems 100, 200, the system 300 is used at the wellsite 152. Generally speaking, some of the components of the system 300 are similar to the components of the systems 100, 200, and thus the same or similar reference numerals are used. In addition, the operational description is not repeated in the interest of brevity, but instead will focus on features of the system 300 that are different from the systems 100, 200. In particular, the system 300 comprises both a reducer-blender transfer outlet 364 and a reducer-bin transfer outlet 368 that are used to direct a processed proppant 305. As described below, the system 300 processes an oversized proppant 306 from a mixed proppant 301 and then either stores the processed proppant 305 for later use or reintroduces the processed proppant 305 into a blender 330 for immediate use for fracturing a well.

Referring still to FIG. 3, the system 300 comprises a hopper 302 containing the mixed proppant 301. The mixed proppant 301 includes the proppant 304 that meets the desired size criteria and the oversized proppant 306 that has a particle size that exceeds the desired size criteria. The system 300 further comprises a hopper valve 308 that is operable to control the flow of the mixed proppant 301 from the hopper 302 to a separator 320. In the example of FIG. 3, the hopper 302 is positioned above the separator 320 such that gravity can flow the mixed proppant 301 through the hopper valve 308. However, the hopper 302 may alternatively be placed at the same height or below the separator 320 and the hopper valve 308 may be replaced with a conveyor belt or auger (not shown), as described for the system 100. The separator 320 includes a screen 322 that has a plurality of passages therethrough that allow the proppant 304 to pass while not passing the oversized proppant 306. In this manner, the mixed proppant 301 is sorted as the proppant 304 is separated from the oversized proppant 306. During operation, the separator 320 may move, shift, or vibrate to urge the separation of the mixed proppant 301. The flow of the proppant 304 is shown moving along a primary flow path 321 that extends downward through a first solids blender-inlet 324 in the blender 330, while the flow of the oversized proppant 306 is shown as the transfer along a diverted flow path 323. In addition, the first solids blender-inlet 324 includes a metering gate 326 used to control the flow of the proppant 304 downstream of the screen 322. The screen 322 is shown angled downward on one edge so that the diverted flow path 323 flows downward toward the lower edge of the screen 322. However, the screen 322 could alternatively not be angled or may be angled upward on one edge such that the diverted flow path 323 extends upwards along the screen 322.

As the proppant 304 moves along the primary flow path 321, the proppant 304 enters the blender 330 and a blender-auger 332 is used to mix the proppant 304 into a slurry with liquids 335 (e.g., water) added from a liquids inlet 334. Other liquid or solid additives may also be added to the slurry mixture from an additives inlet 336. Once mixed into a slurry, the blender-auger 332 moves and transfers the slurry, including the proppant 304, through an outlet 338 in the blender 330. The slurry then flows into a pump 340 that pressurizes the slurry and then flows the pressurized slurry into a wellhead 150 and into an oil or gas-bearing formation below.

The oversized proppant 306 is transferred along the diverted flow path 323 to a reducer 360. As described for the system 100, the reducer 360 may be positioned below the separator 320, as shown in the example of FIG. 3, may be positioned at the same level as the separator 320, or may be positioned higher than the separator 320.

Once the oversized proppant 306 enters the reducer 360, a reducer feed 362 operates to refine (e.g., reduce, break, crush, etc.) the particle size of the oversized proppant 306. As described for the system 100, the example of the system 300 in FIG. 3 uses a cone crusher as the reducer 360, but other methods of particle size refinement are also contemplated. As the generally conical reducer feed 362 rotates, the oversized proppant 306 is advanced from the top of the reducer 360 to the bottom of the reducer 360. The progressively smaller gap between the reducer feed 362 and the housing of the reducer 360, refines (e.g., breaks into smaller particles) the oversized proppant 306 into a processed proppant 305. The processed proppant 305 has substantially the same particle size as the proppant 304, and thus satisfies the desired size criteria. The processed proppant 305 is then directed along one or both of the reducer-blender transfer outlet 364 or the reducer-bin transfer outlet 368. To direct the processed proppant 305, a valve 372 may optionally be used to selectively allow flow along the reducer-bin transfer outlet 368. In the example of FIG. 3, the valve 372 is positioned within the reducer-bin transfer outlet 368, however the valve 372 may alternatively be positioned in other locations. For example, the valve 372 may be placed at the intersection of the reducer-blender transfer outlet 364 and the reducer-bin transfer outlet 368, and operable to selectively direct the processed proppant 305 flow to either of the transfer outlets 364, 368.

Referring again to the example of FIG. 3, by opening the valve 372, some or all of the processed proppant 305 flows along the reducer-bin transfer outlet 368 and is stored in the storage bin 380 for later use with the wellhead 150 or another similar wellhead (not shown). When desired, the storage bin 380 may be removed and replaced with another storage bin (not shown, but substantially the same as the storage bin 380), and the new storage bin may be used to store additional processed proppant 305. By closing the valve 372, the processed proppant 305 is directed along the reducer-blender transfer outlet 364 and is transferred to a second solids blender-inlet 370 with a transfer-auger 366. The processed proppant 305 rejoins the proppant 304 in the blender 330, and at a position downstream of the separator 320. The transfer-auger 366 is coupled to and is operable with the blender-auger 332, such that rotational motions of the augers 332, 366 are the same. However, it is also contemplated that the augers 332, 366 are not coupled and are independently operable.

In the example of FIG. 3, the processed proppant 305 enters the blender 330 at the optional second solids blender-inlet 370 that is spaced apart from the first solids blender-inlet 324. However, it is also contemplated that the second solids blender-inlet 370 may not be spaced apart from the first solids blender-inlet 324, or the second solids blender-inlet 370 and potentially even the transfer-auger 366 may be omitted. Thus the processed proppant 305 may alternatively be added through the first solids blender-inlet 324. When omitting the transfer-auger 366, it is contemplated that the reducer-blender transfer outlet 368 may be configured to convey the processed proppant 305 to the blender 330 with gravity (e.g., via a gravity chute, not shown). Also the processed proppant 305 may optionally be added to the proppant 304 before the processed proppant 305 and the proppant 304 are added to the blender 330.

In addition, as described previously for the system 200, it should be appreciated that the processed proppant 305 satisfies the desired size criteria, and thus the processed proppant 305 in the storage bin 380 may be added to the blender 330 directly (e.g., downstream of the separator 320 and the screen 322). Alternatively, the processed proppant 305 may be added to the separator 320 between the screen 322 and the blender 330 (e.g., downstream of the screen 322 and upstream of the blender 330). Alternatively, the processed proppant 305 in the storage bin 380 may be added to the hopper 302 and thus may again pass through the separator 320 and the screen 322 in the same manner previously described for the mixed proppant 301.

A controller (e.g., controller 600) is used to operate the components of the system 300 to adjust the amount of the mixed proppant 301 added to the system 300, to control the amounts of the proppant 304 and/or the processed proppant 305 added to the blender 330, and to control the amount of the processed proppant 305 that is stored in the storage bin 380. As detailed below, volumetric flowrates of the proppants may be used to coordinate the control of the hopper valve 308, the metering gate 326, the transfer-auger 366, and the valve 372 to ensure the desired total proppant volume is added to the blender 330. The volumetric flow rates may be a directly measured with sensors (such as flowmeters, densitometers, pressure sensors, etc. (not shown)) or may be calculated flowrates. For example, a flowrate of proppant through a known orifice size may be calculated based on a measured time of orifice opening and the degree of opening. Similarly, a flow rate of an auger or conveyor belt can be calculated based on a measured duration of operation and operational speed.

In an example, the volumetric flow of the mixed proppant 301 into the blender 330 is controlled by the hopper valve 308, while the metering gate 326 is omitted, while the transfer-auger 166 is configured for continuous operation, and while the valve 372 is closed such that substantially all of the processed proppant 305 is added to the blender 330.

In another example, the volumetric flow of the mixed proppant 301 is not be measured by the control of the hopper valve 308, but rather the coordinated operation of the metering gate 326, the transfer-auger 366, and the valve 372 to control the total flowrate of the proppants 304, 305 into the blender 330. In particular, the metering gate 326 may include an adjustable orifice or passage (not shown) that can be selectively opened to an adjustable degree for an adjustable duration of time, the combination of which corresponds to a flowrate of the proppant 304 into the blender 330 via the first solids blender-inlet 324. In addition, the valve 372 may be closed to direct the processed proppant 305 towards the transfer-auger 366 and the operational speed of the transfer-auger 366 may then control the flowrate of the processed proppant 305 into the blender 330. In this manner a controller (such as the controller 600) can adjust a duration of opening or a degree of opening of the metering gate 326 to control a first flowrate of the proppant into the blender 330 through the metering gate 326, control a second flowrate of the processed proppant 305 into the blender 330, and selectively control transfer of the processed proppant 305 to the storage bin 380 such that a total amount of the proppant 304 and the processed proppant 305 within the blender 330 is controlled The processed proppant 305 and/or the proppant 304 satisfy the desired size criteria and the resulting slurry mixture is more compatible with the pump 340 (e.g., produces less clogging and/or damage to the pump 340). Additionally, the slurry pumped into the oil or gas-bearing formation has an effective size proppant 304, 305 that both holds open the fractures in the formation, while also not blocking the wellbore fluid flow paths. Additionally, the separation of the oversized proppant 306 and transfer along the diverted flow path 323 occurs concurrently with the addition of the proppant 304 into the blender 330, and thus there is no time delay in using the mixed proppant 301 to fracture the well 154. Further, the particle size refinement of the oversized proppant 306 into the processed proppant 305 may be performed as a continuous process as the well 154 is fractured thus allowing immediate use of the processed proppant 305 in the slurry. In addition, the option to direct the processed proppant 305 to the storage bin 380, allows one system 300 to provide usable proppant that has the desired size criteria to many wells, in addition to the well 154 below the wellhead 150. Thus the system 300 is operable to selectively control transfer of the processed proppant 305 to the storage bin 380 such that a total amount of the proppant 304 and the processed proppant 305 within the blender 330 is controlled.

Figure 4:
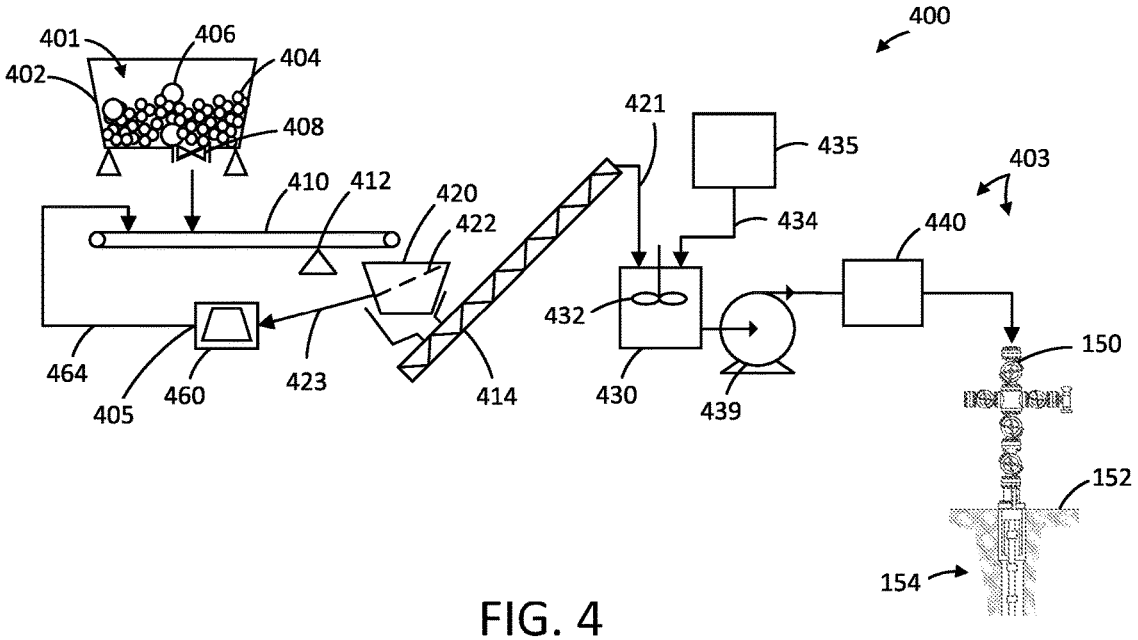
FIG. 4 is a schematic view of another embodiment of a system for processing a mixed proppant within a slurry provided to a wellhead in accordance with the present disclosure.

Referring to FIG. 4, a system 400 is shown that is used in place of the systems 100-300. As described herein, the system 400 is part of a larger fracking system 403 coupled to the wellhead 150 of the well 154 at the wellsite 152. As discussed previously for systems 100-300, the system 400 is used at the wellsite 152. Generally speaking, some of the components of the system 400 are similar to the components of the systems 100-300, and thus the same or similar reference numerals are used. In addition, the operational description is not repeated in the interest of brevity, but instead will focus on features of the system 400 that are different from the systems 100-300. In particular, the system 400 comprises a transfer conveyor 410 that delivers a mixed proppant 401 to a sorter 420 before the proppant 404 of the mixed proppant 401 is provided to a metering conveyor 414. In addition, a reducer 460 is used to process an oversized proppant 406 of the mixed proppant 401 into a processed proppant 405, and the processed proppant 405 is then added back into the transfer conveyor 410.

Referring still to FIG. 4, the system 400 comprises a hopper 402 containing the mixed proppant 401. The mixed proppant 401 includes the proppant 404 that has the desired size criteria and an oversized proppant 406 that is larger than the desired size criteria. The system 400 further comprises a hopper valve 408 that is operable to control the flow of the mixed proppant 401 from the hopper 402 to the transfer conveyor 410. The transfer conveyor 410 may include a load cell 412 to measure the weight of the mixed proppant 401 added to the transfer conveyor 410 and thus a controller (such as controller 600) may monitor the load cell 412 to adjustably control the hopper valve 408 degree of opening and duration of opening to control the flow of the mixed proppant 401. In an example, the hopper valve 408 may be adjusted to produce a constant mass or weight of the mixed proppant 401 such that, the mixed proppant 401 combined with the processed proppant 405 will ensure that during operation of the transfer conveyor 410, a steady supply of the proppant is provided to the separator 420. The operation of the transfer conveyor 410 transfers the mixed proppant 401 to a separator 420. The separator 420 includes a screen 422 that has a plurality of passages therethrough that allow the proppant 404 to pass while not passing the oversized proppant 406. In this manner, the mixed proppant 401 is separated from the oversized proppant 406. During operation, the separator 420 may remain stationary or may move, shift, or vibrate to urge the separation of the mixed proppant 401. The flow of the proppant 404 through the screen 422 is then transferred to the metering conveyor 414, which may for example comprise an auger or a conveyor belt. As described further herein, the operation of the transfer conveyor 410 maintains a supply of the proppant 404 to a first end of the metering conveyor 414, and in doing so ensures that the operation of the metering conveyor 414 delivers a known and consistent volume of the proppant 404 to the second end of the metering conveyor 414 while in operation. In this manner, the volumetric flow rate of the proppant 404 that is delivered by the metering conveyor 414 can be calculated by monitoring the metering conveyor 414 operational speed and the duration of operation, as measured by sensors (not shown) on the metering conveyor 414. The flow of the proppant 404 that is transferred along the metering conveyor 414 and into the blender 430 is shown as a primary flow path 421. A mixer 432 in the blender 430 mixes the proppant 404 with liquids 435 (e.g., water) added through a liquids inlet 434 to form a slurry. Once mixed into a slurry, a discharge pump 439 operates to transfer the slurry to a pump 440 that pressurizes the slurry and then flows the pressurized slurry into the wellhead 150 and into an oil or gas-bearing formation below.

The oversized proppant 406 is transferred along a diverted flow path 423 to a reducer 460. This may be done concurrently with transferring the proppant 404 to the metering conveyor 414. As described for the systems 100-300, the reducer 460 operates to refine (e.g., reduce, break, crush, etc.) the particle size of the oversized proppant 406 and produce a processed proppant 405. The processed proppant 405 has substantially the same particle size as the proppant 404, and thus also satisfies the desired size criteria. The processed proppant 405 is then directed along a reducer-blender transfer outlet 464 and is added back onto the transfer conveyor 410 for being transported to the separator 420. If the processed proppant 405 meets the desired size criteria, the processed proppant 405 will pass through the separator 420 and handled by the metering conveyor 414 with the proppant 404. Thus the system 400 is operable to control the metering conveyor 414 to control a flowrate of the proppant 404 and the processed proppant 405 into the blender 430 to control a total amount of the proppant 404 and the processed proppant 405 in the slurry within the blender 430.

Figure 5:
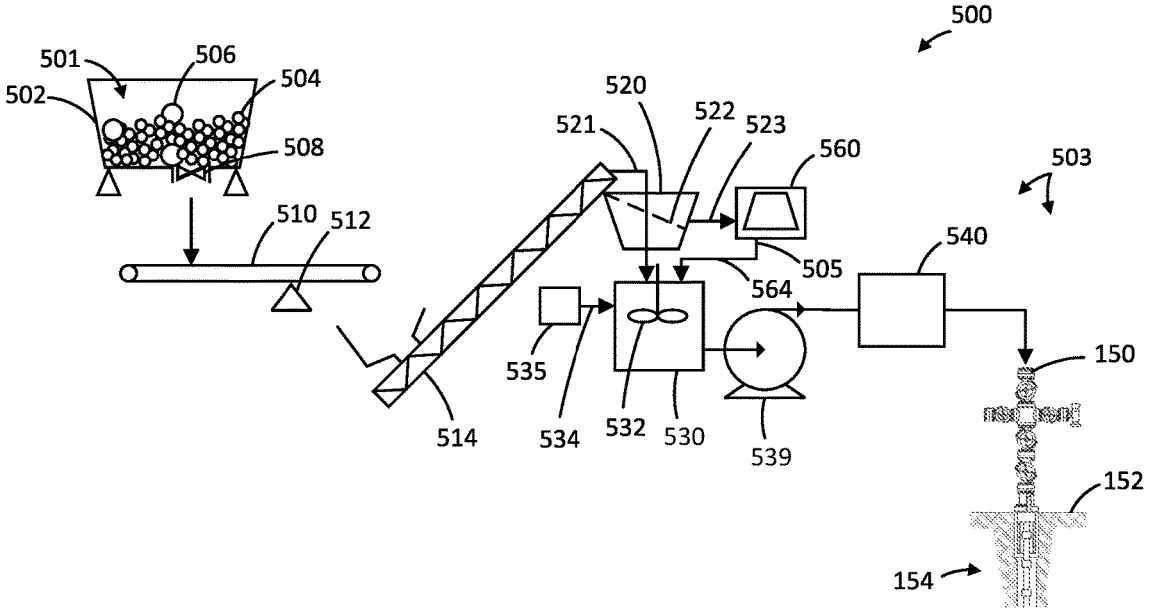
FIG. 5 is a schematic view of another embodiment of a system for processing a mixed proppant within a slurry provided to a wellhead in accordance with the present disclosure.

Referring to FIG. 5, a system 500 is shown that is used in place of the systems 100-400. As described herein, the system 500 is part of a larger fracking system 503 coupled to the wellhead 150 of the well 154 at the wellsite 152. As discussed previously for systems 100-400, the system 500 is used at the wellsite 152. Generally speaking, some of the components of the system 500 are similar to the components of the systems 100-400, and thus the same or similar reference numerals are used. In addition, the operational description is not repeated in the interest of brevity, but instead will focus on features of the system 500 that are different from the systems 100-400. In particular, the system 500 comprises a transfer conveyor 510 that delivers a mixed proppant 501 to a metering conveyor 514 before the mixed proppant 501 is sorted by a separator 520 or processed by a reducer 560.

Referring still to FIG. 5, the system 500 comprises a hopper 502 containing the mixed proppant 501. The mixed proppant 501 includes the proppant 504 that has the desired size criteria and an oversized proppant 506 that is larger than the desired size criteria. The system 500 further comprises a hopper valve 508 that is operable to control the flow of the mixed proppant 501 from the hopper 502 to the transfer conveyor 510. The transfer conveyor 510 may include a load cell 512 to measure the weight of the mixed proppant 501 added to the transfer conveyor 510 and thus a controller (such as the controller 600) may monitor the load cell 512 to adjustably control the hopper valve 508 degree of opening and duration of opening to control the flow of the mixed proppant 501. The operation of the transfer conveyor 510 transfers the mixed proppant 501 to the metering conveyor 514, which may for example comprise an auger or a conveyor belt. The operation of the transfer conveyor 510 maintains a supply of the mixed proppant 501 to a first end of the metering conveyor 514, and in doing so ensures that the operation of the metering conveyor 514 delivers a known and consistent volume of the mixed proppant 501 to the second end of the metering conveyor 514 while in operation. In this manner, the volumetric flow rate of the mixed proppant 501 that is delivered by the metering conveyor 514 can be calculated by monitoring the metering conveyor 514 operational speed and the duration of operation, as measured by sensors (not shown) on the metering conveyor 514. The flow of the mixed proppant 501 that is transferred along the metering conveyor 514 is shown as a primary flow path 521, which extends into a separator 520. The separator 520 includes a screen 522 that has a plurality of passages therethrough that allow the proppant 504 to pass while not passing the oversized proppant 506. In this manner, the mixed proppant 501 is sorted as the proppant 504 is separated from the oversized proppant 506. During operation, the separator 520 may remain stationary or may move, shift, or vibrate to urge the separation of the mixed proppant 501. A mixer 532 in the blender 530 mixes the proppant 504 with liquids 535 (e.g., water) added through a liquids inlet 534 to form a slurry. Once mixed into a slurry, a discharge pump 539 operates to transfer the slurry, to a pump 540 that pressurizes the slurry and then flows the pressurized slurry into the wellhead 150 and into an oil or gas-bearing formation below.

The oversized proppant 506 moves along a diverted flow path 523 to a reducer 560. This may be done concurrently with transferring the proppant 504 along the primary flow path 521. As described for the systems 100-400, the reducer 560 operates to refine (e.g., reduce, break, crush, etc.) the particle size of the oversized proppant 506 and produce a processed proppant 505. The processed proppant 505 has substantially the same particle size as the proppant 504, and thus also satisfies the desired size criteria. The processed proppant 505 is then directed along a reducer-blender transfer outlet 564 and is added to the slurry of the blender 530 and is added at a position downstream of the separator 520.

Figure 6:
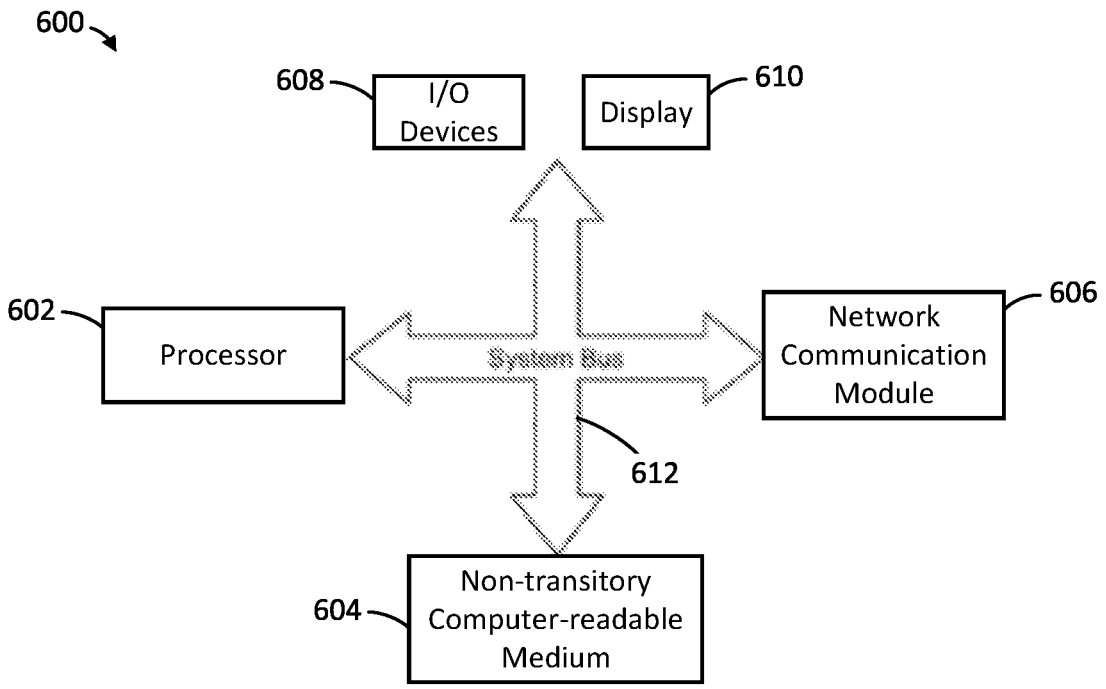
FIG. 6 is a block diagram of a controller, according to one or more embodiments.

Referring to FIG. 6, a block diagram of a controller 600 of a control system that can be used to control the valves, separators, reducers, and augers of the systems 100-300 described above. The controller 600 includes at least one processor 602, a non-transitory computer readable medium 604, an optional network communication module 606, optional input/output devices 608, a data storage drive or device, and an optional display 610 all interconnected via a system bus 612. In at least one embodiment, the input/output device 608 and the display 610 are combined into a single device, such as a touch-screen display. Software instructions executable by the processor 602 for implementing software instructions stored within the controller 600 in accordance with the illustrative embodiments described herein, are stored in the non-transitory computer readable medium 604 or some other non-transitory computer-readable medium. Although not explicitly shown in FIG. 6, it should be recognized that the controller 600 may be connected to one or more public and/or private networks via appropriate network connections. It will also be recognized that software instructions may also be loaded into the non-transitory computer readable medium 604 from an appropriate storage media or via wired or wireless means.

During operation of the systems 100-300 the controller 600 controls the release rate of the mixed proppants 101, 201, 301, 401, 501 by controlling the opening and closing of the valves 108, 208, 308, 408, 508 respectively. The valves 108, 208, 308, 408, 508 may be fully opened, fully closed, or partially open (e.g., may be throttled to a plurality of positions between open and closed). Additionally, the controller 600 may control the operation of the metering gates 126, 226, 326 to control the amount of proppants 104, 204, 304 entering the blenders 130, 230, 330, respectively. Additionally, the controller 600 may control the operation of the separators 120, 220, 320, 420, 520, the reducers 160, 260, 360, 460, 560, and the augers 132, 232, 332. Still further, the controller 600 may control the operation of the metering conveyors 414, 514 to control the amount of proppants added to the blenders 430, 530. For the control of the previously described components, and as described further herein, the controller 600 can use sensor feedback control (e.g., proportional integral differential, "PID control").

In addition to the embodiments described above, many examples of specific combinations are within the scope of the disclosure, some of which are detailed below:

Example 1. A system for processing a mixed proppant at a wellsite for a well, the system comprising:

a separator including a screen configured to receive the mixed proppant that comprises a proppant meeting a desired size criteria and an oversized proppant exceeding the desired size criteria, sort the proppant from the oversized proppant, direct the proppant along a primary flow path to a blender, and direct the oversized proppant along a diverted flow path to a reducer; and wherein the reducer is operable to process the oversized proppant into a processed proppant that meets the desired size criteria.

Example 2. The system of Example 1 wherein the reducer comprises a cone crusher.

Example 3. The system of Example 1 further comprising a reducer-blender transfer outlet between the reducer and the blender, the reducer-blender transfer outlet is configured to direct at least some of the processed proppant into the blender.

Example 4. The system of Example 1 further comprising a reducer-bin transfer outlet between the reducer and a storage bin, wherein the reducer-bin transfer outlet is configured to direct at least some of the processed proppant into the storage bin.

Example 5. The system of Example 1 further comprising:
a metering gate between the separator and the blender;
a reducer-blender transfer outlet between the reducer and the blender, the reducer-blender transfer outlet is configured to convey the processed proppant to the blender;
a blender-auger within the blender operable to mix the proppant and the processed proppant;
a valve within a reducer-bin transfer outlet between the reducer and a storage bin; and
a controller programmed to control the operation of the metering gate to control a first flowrate of the proppant into the blender through the metering gate, control a second flowrate of the processed proppant into the blender, and selectively control transfer of the processed proppant to the storage bin such that a total amount of the proppant and the processed proppant within the blender is controlled.

Example 6. The system of Example 1 further comprising a pump connected to the blender, wherein the pump is operable to transfer the proppant through a wellhead and into the well.

Example 7. The system of Example 1 further comprising:
a transfer-auger within a reducer-blender transfer outlet, the transfer-auger is operable to convey the processed proppant to the blender;
a blender-auger within the blender operable to convey the proppant and the processed proppant from the blender to a pump; and
wherein the blender-auger is coupled to and operates together with the transfer-auger.

Example 8. The system of Example 1 further comprising:
a transfer conveyor operable to transfer the mixed proppant and the processed proppant to the separator; and
a metering conveyor operable to transfer the proppant and the processed proppant from the separator to the blender.

Example 9. The system of Example 1 further comprising:
a metering conveyor operable to transfer the mixed proppant to the separator; and
wherein the processed proppant from the reducer bypasses the separator and is added into the blender.

Example 10. A method for processing a mixed proppant at a wellsite, the method comprising:
transferring the mixed proppant to a separator at the wellsite, the mixed proppant comprising a proppant meeting a desired size criteria and an oversized proppant exceeding the desired size criteria and the separator comprising a screen;
operating the separator to sort the proppant from the oversized proppant;
directing the proppant along a primary flow path to a blender at the wellsite;
directing the oversized proppant along a diverted flow path to a reducer at the wellsite; and
processing the oversized proppant in the reducer at the wellsite into a processed proppant that meets the desired size criteria.

Example 11. The method of Example 10 further comprising directing at least some of the processed proppant from the reducer along a reducer-bin transfer outlet to a storage bin such that a total amount of the proppant and the processed proppant within the blender is controlled.

Example 12. The method of Example 10 further comprising:
controlling a flowrate of the proppant through a metering gate into the blender; and
operating at least one of a valve or a transfer-auger to direct the processed proppant to the blender or a storage bin based on the flowrate of the proppant through the metering gate.

Example 13. The method of Example 10 further comprising pumping the proppant from the blender, through a wellhead, and into a well.

Example 14. The method of Example 10 further comprising directing the processed proppant along a reducer-blender transfer outlet from the reducer and into the blender such that the processed proppant bypasses the separator.

Example 15. The method of Example 10 further comprising controlling a metering conveyor to control a flowrate of the proppant and the processed proppant into the blender to control a total amount of the proppant and the processed proppant in a slurry within the blender.

Example 16. The method of Example 10 wherein the processed proppant is added to proppant before the processed proppant is added to the blender.

Example 17. The method of Example 10 further comprising:
operating a blender-auger that is coupled to and operable together with a transfer-auger;
transferring the processed proppant with the transfer-auger into the blender; and
mixing the proppant and the processed proppant with the blender-auger to form a slurry within the blender.

Example 18. A fracking system for a well at a wellsite, the fracking system comprising:
a hopper containing a mixed proppant that comprises a proppant meeting a desired size criteria and an oversized proppant exceeding the desired size criteria;
a separator including a screen operable to receive the mixed proppant, sort the proppant from the oversized proppant, direct the proppant along a primary flow path to a blender, and direct the oversized proppant along a diverted flow path to a reducer, wherein the reducer is operable to process the oversized proppant into a processed proppant that meets the desired size criteria;
a reducer-blender transfer outlet operable to direct at least some of the processed proppant to the blender; and
wherein the blender is operable to mix the proppant and the processed proppant into a slurry that is transferable by a pump into the well.

Example 19. The fracking system of Example 18 further comprising a valve within a reducer-bin transfer outlet between the reducer and a storage bin, wherein operation of the valve selectively allows the processed proppant to enter the storage bin.

Example 20. The fracking system of Example 18 further comprising a metering conveyor operable to transfer the proppant and the processed proppant to the blender.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system for processing a mixed proppant at a wellsite for a well, the system comprising:

a separator including a screen configured to receive the mixed proppant that comprises a proppant meeting a desired size criteria and an oversized proppant exceeding the desired size criteria, sort, prior to directing the oversized proppant along a diverted flow path to a reducer, the proppant from the oversized proppant, direct all of the sorted proppant along a primary flow path to a blender, and direct all of the sorted oversized proppant along the diverted flow path to the reducer, wherein all of the sorted proppant bypasses the reducer and all of the sorted oversized proppant is routed through the reducer; and wherein the reducer is operable to process the sorted oversized proppant into a processed proppant that meets the desired size criteria.

2. The system of claim 1 wherein the reducer comprises a cone crusher.

3. The system of claim 1 further comprising a reducer-blender transfer outlet between the reducer and the blender, the reducer-blender transfer outlet is configured to direct at least some of the processed proppant into the blender.

4. The system of claim 1 further comprising a reducer-bin transfer outlet between the reducer and a storage bin, wherein the reducer-bin transfer outlet is configured to direct at least some of the processed proppant into the storage bin.

5. The system of claim 1 further comprising:

a metering gate between the separator and the blender;

a reducer-blender transfer outlet between the reducer and the blender, the reducer-blender transfer outlet is configured to convey the processed proppant to the blender;

a blender-auger within the blender operable to mix the proppant and the processed proppant;

a valve within a reducer-bin transfer outlet between the reducer and a storage bin; and a controller programmed to control the operation of the metering gate to control a first flowrate of the proppant into the blender through the metering gate, control a second flowrate of the processed proppant into the blender, and selectively control transfer of the processed proppant to the storage bin such that a total amount of the proppant and the processed proppant within the blender is controlled.

6. The system of claim 1 further comprising a pump connected to the blender, wherein the pump is operable to transfer the proppant through a wellhead and into the well.

7. The system of claim 1 further comprising:

a transfer-auger within a reducer-blender transfer outlet, the transfer-auger is operable to convey the processed proppant to the blender;

a blender-auger within the blender operable to convey the proppant and the processed proppant from the blender to a pump; and wherein the blender-auger is coupled to and operates together with the transfer-auger.

8. The system of claim 1 further comprising:

a transfer conveyor operable to transfer the mixed proppant and the processed proppant to the separator; and a metering conveyor operable to transfer the proppant and the processed proppant from the separator to the blender.

9. The system of claim 1 further comprising:

a metering conveyor operable to transfer the mixed proppant to the separator; and wherein the processed proppant from the reducer bypasses the separator and is added into the blender.

10. A method for processing a mixed proppant at a wellsite, the method comprising:

transferring the mixed proppant to a separator at the wellsite, the mixed proppant comprising a proppant meeting a desired size criteria and an oversized proppant exceeding the desired size criteria and the separator comprising a screen;

operating the separator to sort, prior to directing the sorted oversized proppant along a diverted flow path through a reducer, the proppant from the oversized proppant;

directing the sorted proppant along a primary flow path to a blender at the wellsite;

directing the sorted oversized proppant along the diverted flow path to the reducer at the wellsite, wherein all of the sorted proppant bypasses the reducer and all of the sorted oversized proppant is routed through the reducer; and processing all of the sorted oversized proppant in the reducer at the wellsite into a processed proppant that meets the desired size criteria.

11. The method of claim 10 further comprising directing at least some of the processed proppant from the reducer along a reducer-bin transfer outlet to a storage bin such that a total amount of the proppant and the processed proppant within the blender is controlled.

12. The method of claim 10 further comprising:

controlling a flowrate of the proppant through a metering gate into the blender; and operating at least one of a valve or a transfer-auger to direct the processed proppant to the blender or a storage bin based on the flowrate of the proppant through the metering gate.

13. The method of claim 10 further comprising pumping the proppant from the blender, through a wellhead, and into a well.

14. The method of claim 10 further comprising directing the processed proppant along a reducer-blender transfer outlet from the reducer and into the blender such that the processed proppant bypasses the separator.

15. The method of claim 10 further comprising controlling a metering conveyor to control a flowrate of the proppant and the processed proppant into the blender to control a total amount of the proppant and the processed proppant in a slurry within the blender.

16. The method of claim 10 wherein the processed proppant is added to proppant before the processed proppant is added to the blender.

17. The method of claim 10 further comprising:

operating a blender-auger that is coupled to and operable together with a transfer-auger;

transferring the processed proppant with the transfer-auger into the blender; and mixing the proppant and the processed proppant with the blender-auger to form a slurry within the blender.

18. A fracking system for a well at a wellsite, the fracking system comprising:

a hopper containing a mixed proppant that comprises a proppant meeting a desired size criteria and an oversized proppant exceeding the desired size criteria;

a separator including a screen operable to receive the mixed proppant, sort, prior to directing the oversized proppant along a diverted flow path to a reducer, the proppant from the oversized proppant, direct all of the sorted proppant along a primary flow path to a blender, and direct all of the sorted oversized proppant along a diverted flow path to a reducer, wherein all of the sorted proppant bypasses the reducer and all of the sorted oversized proppant is routed through the reducer, wherein the reducer is operable to process the sorted oversized proppant into a processed proppant that meets the desired size criteria;

a reducer-blender transfer outlet operable to direct at least some of the processed proppant to the blender; and wherein the blender is operable to mix the proppant and the processed proppant into a slurry that is transferable by a pump into the well.

19. The fracking system of claim 18 further comprising a valve within a reducer-bin transfer outlet between the reducer and a storage bin, wherein operation of the valve selectively allows the processed proppant to enter the storage bin.

20. The fracking system of claim 18 further comprising a metering conveyor operable to transfer the proppant and the processed proppant to the blender.

* * * * *